US007740398B2

(12) United States Patent
Cline et al.

(10) Patent No.: US 7,740,398 B2
(45) Date of Patent: Jun. 22, 2010

(54) DYNAMIC MIXER

(75) Inventors: David J. Cline, Newport Beach, CA (US); Truc S. Tang, Santa Ana, CA (US); Richard T. Naruo, Tustin, CA (US); Stephen P. Gordon, Tustin, CA (US)

(73) Assignee: Fluid Research Corporation, Tustin, CA (US)

( * ) Notice: Subject to any disclaimer, the term of this patent is extended or adjusted under 35 U.S.C. 154(b) by 846 days.

(21) Appl. No.: 11/538,787

(22) Filed: Oct. 4, 2006

(65) Prior Publication Data

US 2008/0084785 A1 Apr. 10, 2008

(51) Int. Cl.
*B01F 7/04* (2006.01)

(52) U.S. Cl. ..... 366/143; 366/325.93; 366/328.2; 366/331

(58) Field of Classification Search ..... 366/143, 366/224, 325.1, 325.92, 325.93, 328.2–328.4, 366/329.1, 329.2, 331
See application file for complete search history.

(56) References Cited

U.S. PATENT DOCUMENTS 4,101,384 A * 7/1978 Faust et al. ..... 435/298.1
4,304,494 A * 12/1981 Lutz ..... 366/343
4,364,667 A * 12/1982 Reiner ..... 366/325.3
4,449,826 A * 5/1984 Mathis et al. ..... 366/13

(Continued)

FOREIGN PATENT DOCUMENTS

JP 2000-238030 * 9/2000

(Continued)

OTHER PUBLICATIONS

Nippon Shoryoku Giken, Inc., Diagram Explaining The Mixed State At The Inside of Mixer Cartridge, http://www.mgptec.co.jp/Index_e.htm, dated Jul. 24, 2003, Chiba-Ken, Japan, 274-0825, 3 pages.

(Continued)

*Primary Examiner*—Charles E Cooley
(74) *Attorney, Agent, or Firm*—Larry K. Roberts

(57) ABSTRACT

A dynamic mixer includes a housing structure having a mixing chamber, having an inlet opening through which a material or materials to be mixed is passed into the mixing chamber and an outlet. A mixer rod has mixing rod portion disposed in the housing structure and a plurality of mixing paddle portions each having a mixing surface. The mixing rod is adapted for attachment to a drive unit which imparts a rotational mixing force to the rod. In one exemplary non-limiting embodiment of a mixer, the housing structure includes a hollow tubular structure with first and second open ends, a hollow T fitting having a first opening attached to the first end of the hollow tubular structure, a second opening opposed to and in alignment with the first opening and a third opening transverse to the first and second openings, and a coupler fitting attached to the second open end of the tubular structure. An end cap structure is attached to the second opening of the T fitting for supporting the rod drive portion for rotation and sealing against material leakage. A support structure is positioned at the second open end of the tubular structure and secured in place by the coupler fitting, to support the drive rod while permitting material flow out the open second end.

34 Claims, 5 Drawing Sheets

U.S. PATENT DOCUMENTS

| | | | | | |
|---|---|---|---|---|---|
| 4,478,515 | A | * | 10/1984 | Tobin | 366/67 |
| 4,900,158 | A | * | 2/1990 | Ugolini | 366/143 |
| 5,151,288 | A | * | 9/1992 | Curry et al. | 426/474 |
| 5,580,170 | A | * | 12/1996 | Holley et al. | 366/325.1 |
| 5,626,421 | A | * | 5/1997 | Campbell | 366/147 |
| 5,723,517 | A | * | 3/1998 | Campo et al. | 523/303 |
| 6,405,899 | B1 | | 6/2002 | Cline et al. | |
| 6,863,432 | B2 | | 3/2005 | Schuchardt et al. | |
| 7,449,330 | B2 | * | 11/2008 | Bouldin | 435/290.2 |
| 2008/0084785 | A1 | * | 4/2008 | Cline et al. | 366/142 |

FOREIGN PATENT DOCUMENTS

WO 86/06651 * 11/1986

OTHER PUBLICATIONS

Kirkco, Two Component Systems "Mixing Valves", downloaded from http://www.kirkcocorp.com/mixvalve.htm, Mar. 27, 2003, Monroe, NC 28111, 1 page.

ASI, Dynamic Mixers "ASI Dynamic Mixers", downloaded from http://hplc-asi.com/products/mixers/dynamic_mixers.hts, Mar. 27, 2003, Monroe, NC 28111, 1 page.

Cecil Instruments, Dynamic Mixers, downloaded from http://www.cecilinstruments.com/hplc-instruments.html; Mar. 27, 2003, 1 page.

Edge-Sweets Co. Low Pressure M-100 Mix Head, downloaded from http://www.edge-sweets.com/polyurethane-equipment/machinery/metering-dispensing/ . . . , Oct. 12, 2005, 1 page.

Edge-Sweets Co. Low Pressure M-200 Mix Head, downloaded from http://www.edge-sweets.com/polyurethane-equipment/machinery/metering-dispensing/ . . . , Oct. 12, 2005, 1 page.

Edge-Sweets Co., Low Pressure MSCO Mix Head, downloaded from http://www.edge-sweets.com/polyurethane-equipment/machinery/metering-dispensing/ . . . , Oct. 12, 2005, 1 page.

Azon, Model-50 AZO-Meter™, www.azonintl.com, Kalamazoo, MI 49008-1910, dated 2004, 2 pages.

Scargills Equipment Service Inc., SESco Proportioner, downloaded from http://sescoequip.com/_wsn/page3.html, Oct. 12, 2005, 3 pages.

Nordson Corporation, Form-In-Place Gasketing System for Hard Disk Drives, Amherst, Ohio 44001, dated 2000, 2 pages.

Reinhardt Technik, RT2, Casting, dated 2000, 2 pages.

I&J70, Final Mixing Options, downloaded from http://www.ijfisnar.com.tw/Me20.htm; Oct. 12, 2005, 3 pages.

Asahi Techneion Co., Ltd., Products and Services, downloaded from http://www.asahi-technician.co.jp/english/pro, Oct. 12, 2005,3 pages.

Kirkco, "Mixing Valves", downloaded from http://www.kirkcocorp.com/2applica.htm, Oct. 12, 2005, Monroe, NC 28111, 2 pages.

MDL Products, Product Index: Manufacturing Equipment and Software: Automation/ Custom Equipment: In-Line Mixer, Liquid Control Corp., North Canton, OH 044720, downloaded from http://www.devicelink.com/industry/ products/745.html; Oct. 12, 2005, 1 page.

Tah Industries, Mixers & Acessories, downloaded from http://www.tah.com/display_subseries.php?aid=1&said=3&sid=47&ssid=72, Oct. 12, 2005, 1 page.

Decker Industries, Inc., Application Profile—Polyurethane Foam Molding, The Paradyne Mix Head Allows Increased Production For An Automotive Supplier, (14-1) #1004, Palm City, Florida 34990, dated 2002, 1 page.

Hilger U. Kern / Dopag Group, Dopag Metering Technology Mixing Systems Static-Dynamic Mixer, downloaded from http:www.dopag.ch/dosiertechnik/mischsysteme/ statisch_dynamisch/index_e.php, Oct. 12, 2005, 1 page.

Sulzer Chemtech, VIP Mixer, Switzerland, 2 pages.

Produkte, The Dynamic Mixer, downloaded from http://www.indag.de/indag_website/englisch/products/ durchlauf.htm, Oct. 12, 2005, 1 page.

Dynamic Heads, 70 Series Dynamic Mixing-Head, downloaded from http://www.dispensinglink.com/dynamic_head.htm, Mar. 27, 2003, 1 page.

Dynamic Heads, Integrated Dispensing Solutions, downloaded from http://www.dispensinglink.com/dynamic_head.htm, Mar. 27, 2003, 2 pages.

Adhesives & Sealants Searchable Buyers Guide, ASI Buyers' Guide Search Results, Pennsauken, NJ 08109, downloaded from http:www.bnp.com/cgi-bin/asi/DB_Search/db_search.cgi, Mar. 27, 2003, 5 pages.

Mixer Manual Version 3.1, Dynamic Mixer Data Sheet, Mixer Manual Version 3.1, 1 page (updated).

Cecil Instruments, About Adept, Top Performance HPLC, downloaded from http://www.cecilinstruments.com/hplc-1.html; Mar. 27, 2003, 2 pages.

Cecil Instruments, list, downloaded from http://www.cecilinstruments.com/hplc-ordering.html; Mar. 27, 2003, 1 page.

* cited by examiner

FIG. 5
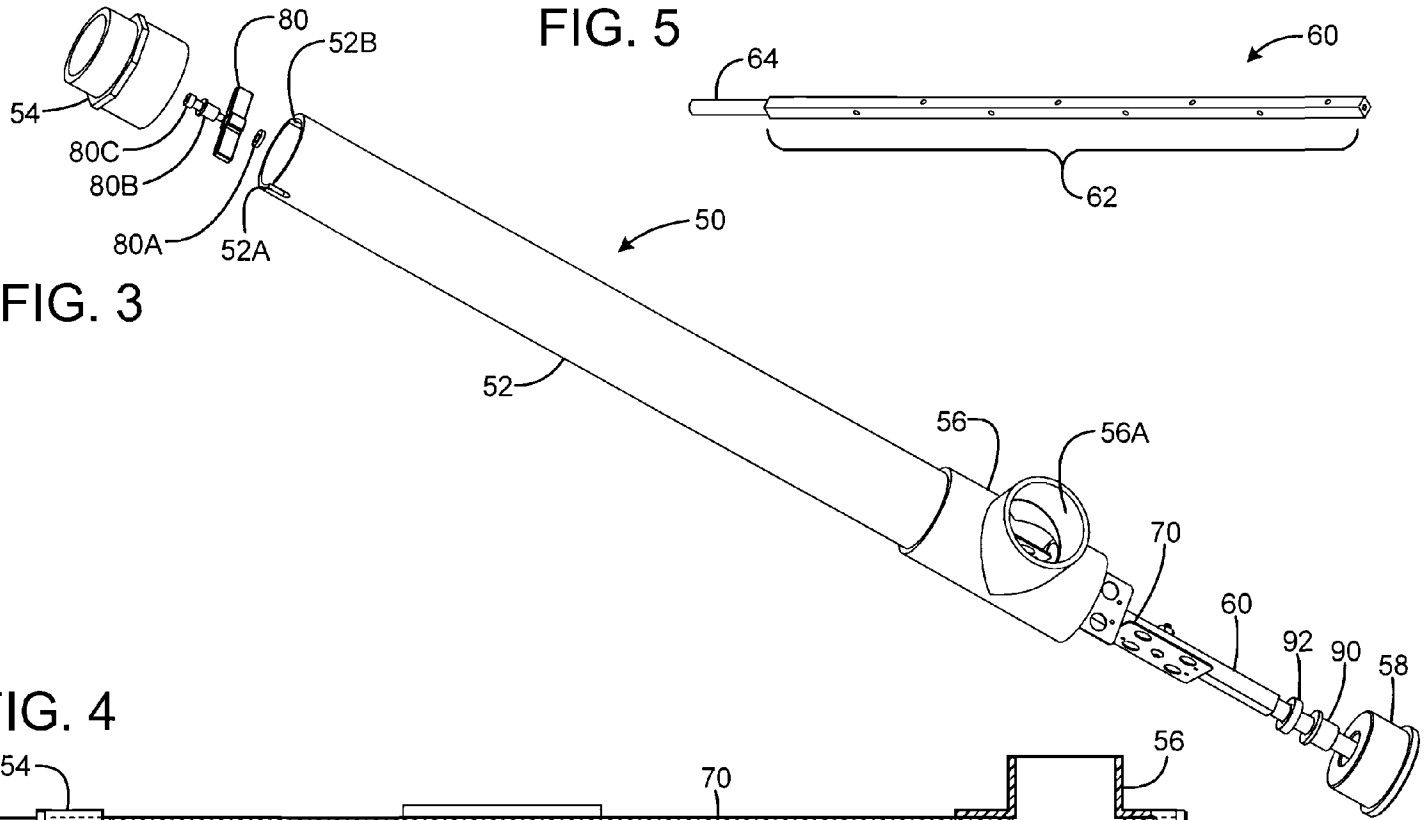
FIG. 3
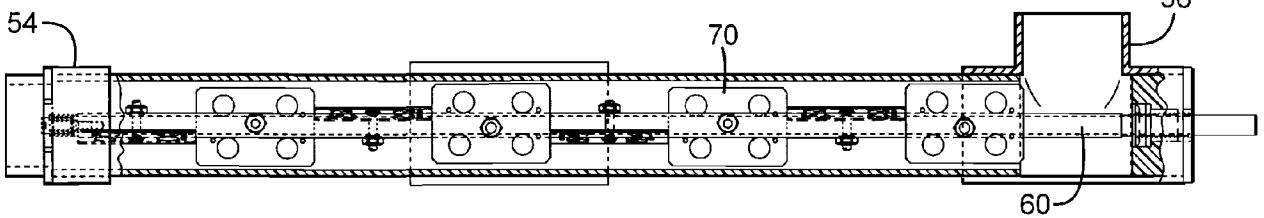
FIG. 4

FIG. 6
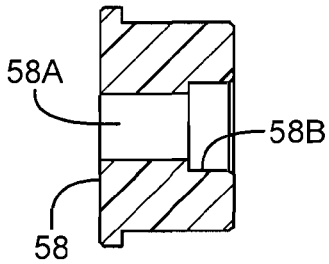
FIG. 7
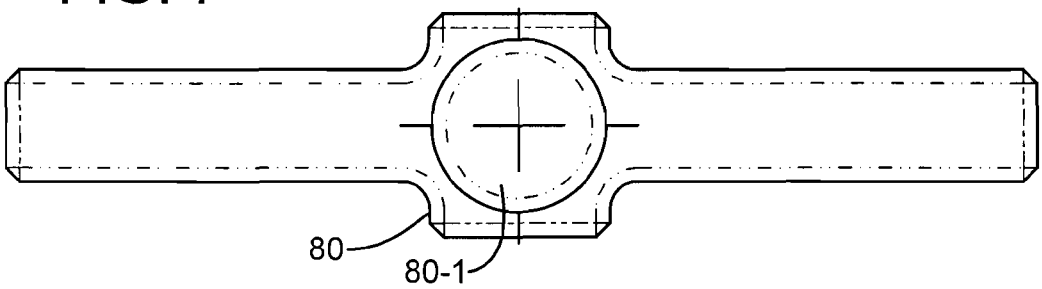
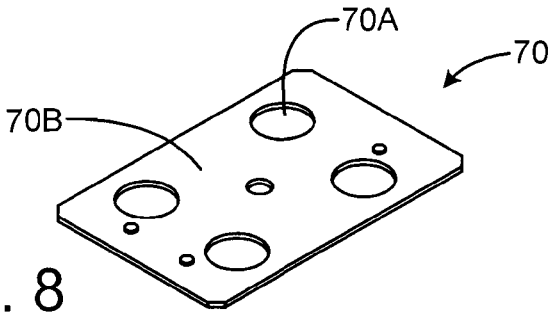
FIG. 8

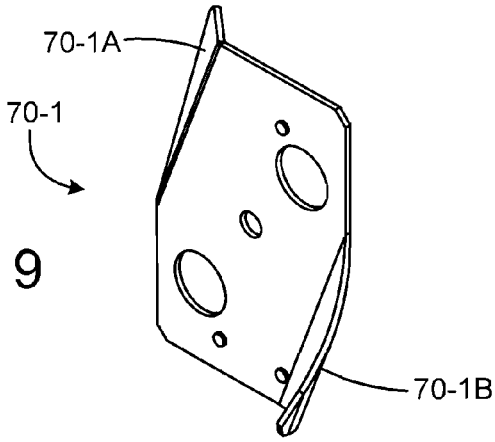
FIG. 9
FIG. 10
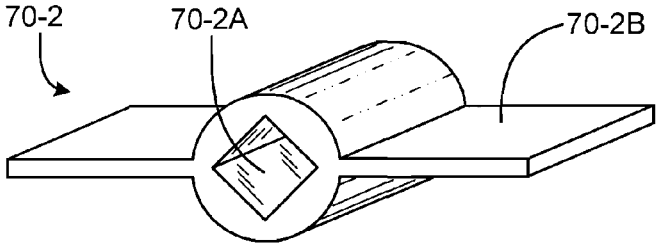
FIG. 11
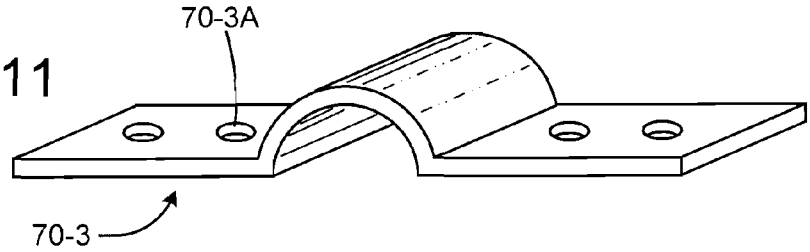

DYNAMIC MIXER

BACKGROUND

Systems for mixing and dispensing single and multiple component fluid materials are known in the art. In the case of multiple component materials, the systems may include mechanisms for pumping the components to a mixing device that thoroughly mixes the components together. The mixed composition then flows out the mixing device for use. For example, the components may be reactive materials that require stirring or mixing for a reaction to take place, e.g., multi-part epoxies, silicones, polyesters, urethanes and acrylics, or non-reactive components that are mixed or stirred together, e.g., components of different colors which are mixed together to provide a composite color, liquids and solids, powders.

Dynamic mixing devices known in the art have generally been relatively expensive devices. The devices can be relatively difficult to clean after use, and thus are relatively expensive to maintain as well.

BRIEF DESCRIPTION OF THE DRAWINGS

Features and advantages of the disclosure will readily be appreciated by persons skilled in the art from the following detailed description when read in conjunction with the drawing wherein:

FIG. 3 is an isometric partially exploded view of an exemplary embodiment of a dynamic mixer.

FIG. 4 is a cutaway view illustrating aspects of the dynamic mixer of FIG. 3.

FIG. 5 is an isometric view illustrating an exemplary embodiment of a mixing rod for the dynamic mixer of FIG. 3.

FIG. 6 is a cross-sectional view of an exemplary embodiment of an end cap for the dynamic mixer of FIG. 3.

FIG. 7 is a front view illustrating an exemplary embodiment of a rod-supporting boss for the dynamic mixer of FIG. 3.

FIG. 8 is an isometric view of an exemplary embodiment of a mixer paddle structure.

FIG. 9 is an isometric view of another exemplary embodiment of a mixer paddle structure.

FIG. 10 is a side view of yet another exemplary embodiment of a mixer paddle structure.

FIG. 11 is a side view of another exemplary embodiment of a mixer paddle structure.

DETAILED DESCRIPTION

Figure 1:
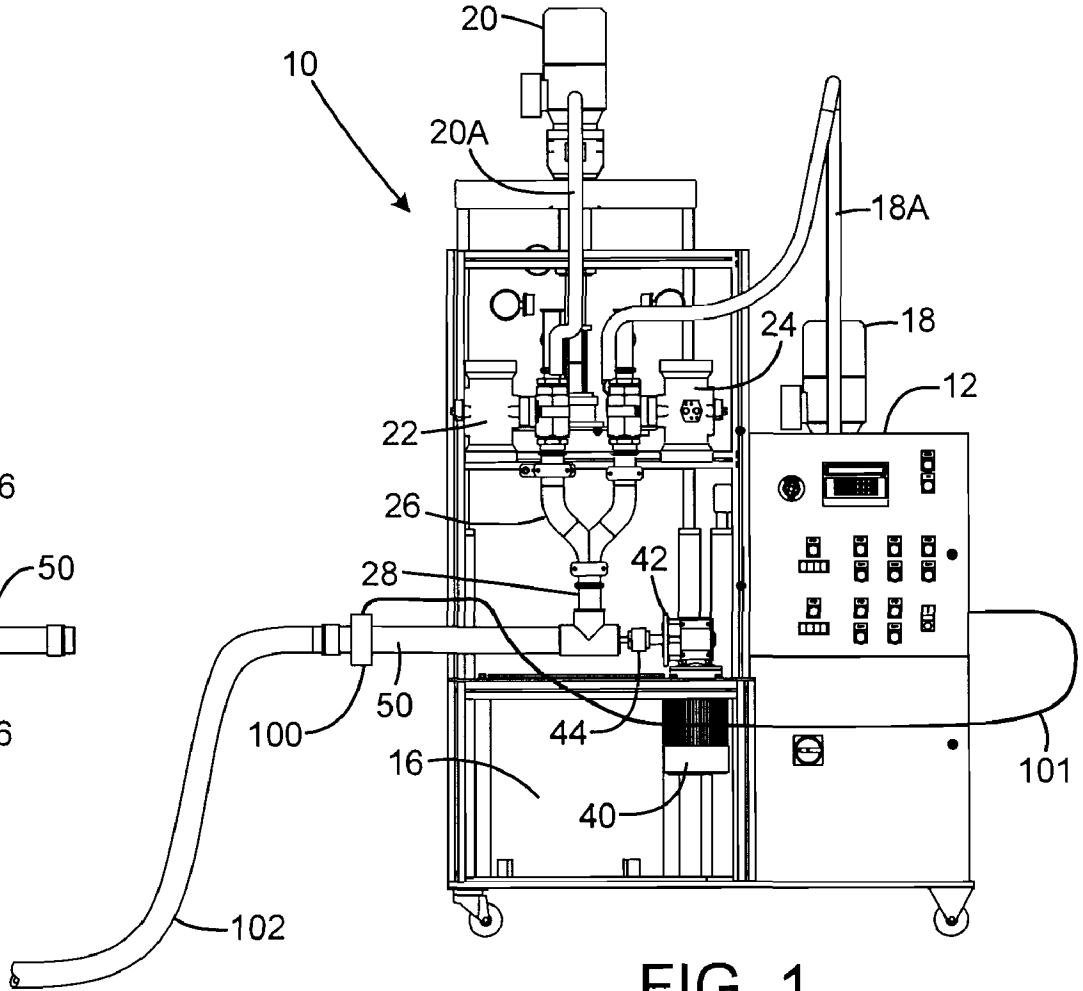
FIGS. 1 and 2 are respective front and review views of an exemplary embodiment of a fluid dispensing station with a mixer.

In the following detailed description and in the several figures of the drawing, like elements are identified with like reference numerals. The figures are not to scale, and relative feature sizes may be exaggerated for illustrative purposes.

An exemplary non-limiting embodiment of a dynamic mixer may be of relatively low cost, and may be a disposable apparatus, wherein the user may elect to dispose of the mixer after a use rather than clean the mixer, obviating time-consuming cleaning tasks associated with conventional dynamic mixer devices. The mixer may be provided with connectors which may be readily attached to fluid conduits carrying the fluid to be mixed to the mixer, e.g. to input conduit(s), and the mixed fluid, e.g. an output conduit.

Figure 2:
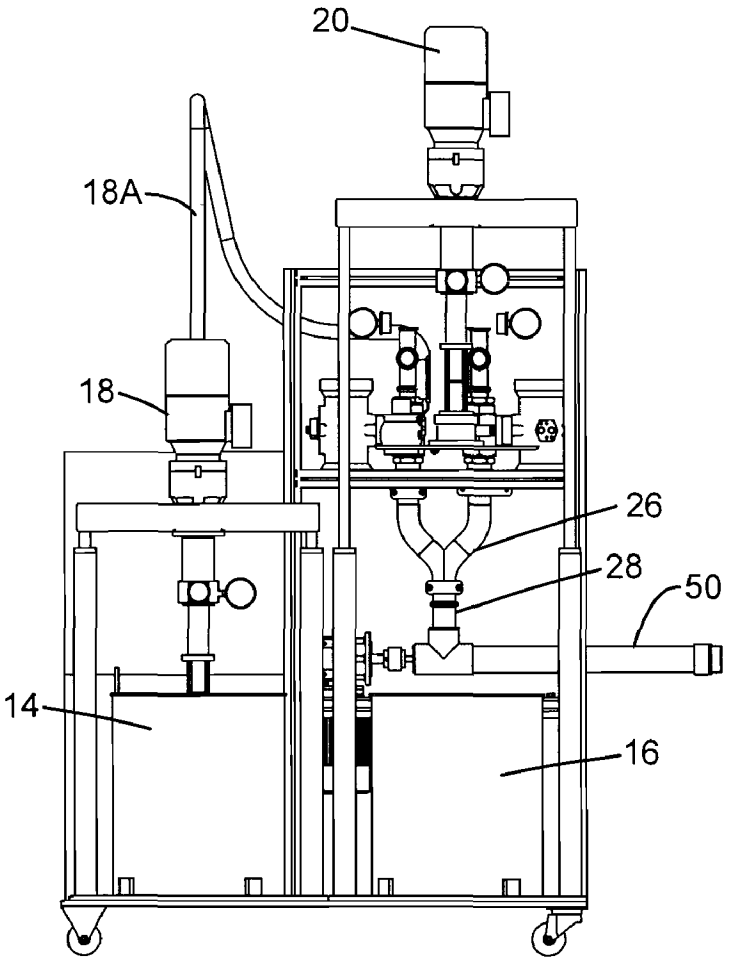

An exemplary operating environment for a dynamic mixer is in a fluid dispensing system. An exemplary fluid dispensing system is depicted in FIGS. 1 and 2. It is to be understood that the system depicted in FIGS. 1 and 2 is merely exemplary; a dynamic mixer may also be employed in many other operating environments and with other dispensing systems. Another exemplary dispensing system is described in U.S. Pat. No. 6,405,899.

The exemplary dispensing system 10 in general includes a control system 12, and supply sources, e.g. drums 14, 16 of two components to be mixed together and dispensed. Progressing cavity pumps for each component are mounted to rams generally depicted as 18 and 20 for movement along respective vertical axes to position the pumps in the drums 14, 16 during operation, or to move them away from the drums for loading fresh drums. The pumps delivery the respective components through conduits 18A, 20A and valves 22, 24 to a Y fitting 26. The output of the Y fitting is coupled to an inlet port of a dynamic mixer 50 through a coupler fitting 28. A flexible hose 102 may be attached to the output of the mixer 50 by an output coupler fitting, to direct the mixture to a desired location or destination.

Non-limiting examples of the components include reactive materials that require stirring or mixing for a reaction to take place, e.g., multi-part epoxies, silicones, polyesters, urethanes and acrylics, or non-reactive components that are mixed or stirred together, e.g., components of different colors which are mixed together to provide a composite color, liquids and solids, powders. Once mixed together, the mixed components may cure in some exemplary applications.

The dynamic mixer 50 is coupled to a drive unit 40, in this exemplary embodiment through a right angle coupler 42 and a mixer coupler 44. In an exemplary embodiment, the drive unit 40 may be an electric or pneumatic motor unit. In other embodiments, the drive unit may be connected to the mixer by a straight coupler.

FIGS. 3-8 illustrate further details of an exemplary embodiment of a dynamic mixer 50. The mixer 50 includes a hollow housing structure 52, which in an exemplary embodiment is a hollow tube defining a mixing chamber. The structure 52 may be fabricated of a plastic material, e.g. ABS, PVC, or polyvinyl butadiene, or of a metal such as steel aluminum or copper. In an exemplary embodiment, the structure may be fabricated of a transparent material, e.g. transparent ABS or PVC, although the particular material from which the structure is fabricated may be dependent on the particular materials to be mixed.

An advantage of a transparent housing structure is that an operator of the dispensing system may be able to determine visually whether the mixing of the components is of a satisfactory degree, and can take steps to adjust the dispensing parameters based on a visual inspection through the transparent material. If the two components being mixed are of different colors, for example, the operator may readily observe whether a thorough mixing of the two components is being achieved. If not, the speed of rotation of the drive unit 40 may be adjusted, and/or the pumping rates of the progressing pumps 18, 20 may be adjusted, until satisfactory mixing is occurring.

It is also contemplated that an exemplary non-limiting embodiment of a dynamic mixer may include a sensor, e.g. a photosensing device, may be included at or adjacent the output of the mixer to monitor a parameter of the mixed components, e.g. the color of the mixture, to provide an electronic feedback signal to the control system to adjust the pumps and mixer drive motor, or signal an error if certain parameters are not met, e.g. color parameters.

The exemplary embodiment of the mixer 50 further may include fittings at each end of the housing structure 52. The output end of the housing structure may have a fitting 54 attached, which may be, e.g., a male coupler fitting for attachment of a fluid conduit (not shown) to deliver the mixed fluid to a working site. The input end of the housing structure 52 may have a fitting 56 attached thereto, which may be a T fitting. In an exemplary embodiment, the housing structure may be fabricated of a rigid plastic material such as readily available ABS or PVC tubing, and the fittings 54, 56 also fabricated of readily available PVC such as a male PVC coupler and a PVC T fitting with open ports at each end and in a transverse portion. The port 56A in the transverse portion may be employed as the inlet port or opening of the mixer 50, into which the fluid to be mixed is admitted. In an exemplary embodiment, the housing structure 52 may be a length of transparent ABS, 2 inches in diameter, and the fittings 54 and 56 may be sized to slip onto the ends of the tube 52 and attached by adhesive cement.

An exemplary embodiment of the mixer 50 includes a mixer rod 60, which is supported for rotation within the housing structure. Attached to the rod is a plurality of mixer paddles 70. The rod 60 in an exemplary embodiment has a mixer portion 62 (FIG. 5) which has a rectangular, e.g. square, cross-sectional configuration, and a drive connection portion 64, which has a circular cross-sectional configuration. In an exemplary embodiment, the paddles 70 may be attached to the mixer portion 62 of the mixer rod 60. The rod 60 may be fabricated from many different materials; in an exemplary embodiment the material may be an aluminum alloy. Other materials may alternatively be used. The rod in an exemplary embodiment is ½ inch square in the mixer portion 62, and may be machined to be circular with a ½ inch diameter in portion 64.

The mixer paddles 70 may be attached to the rod by various means, including in an exemplary non-limiting embodiment, threaded bolts passed through openings, e.g. bores, formed in the rod at separated locations and secured by threaded nuts. Other exemplary attachment means include welding, riveting, brazing, soldering and adhesive connections. The paddles may be inserted through slots formed in the rod in another non-limiting embodiment. Another alternative is to stamp or form the paddles with an integral mounting hub which is fitted onto a mixing rod having a non-circular cross-sectional configuration. The mounting hub may for example have a square opening which allows the paddle unit to be slid onto the rod; the engagement of the rod and paddle hub prevents rotation of the paddle about the rod. In other exemplary embodiments, the paddles and the mixing rod may be fabricated in a unitary structure, e.g. by molding, casting or the like.

As depicted in FIGS. 3 and 4, the mixer paddles may be attached to the rod in the mixer portion 62 in a progressive, staggered arrangement, wherein adjacent paddles are attached to surfaces which meet at right angles. Thus, in an exemplary embodiment, every other paddle may be attached to surfaces which are parallel.

In an exemplary embodiment, the mixer rod 60 may be supported at each end of the housing structure for rotation about the rod axis. At the output end, the rod may be supported by a boss key 80, also shown in FIG. 7, which has a length generally equal or slightly less than the diameter of the housing structure 52. The opposite ends of the boss key 80 are adapted to fit into slots 52A, 52B cut or formed in the output end of the structure 52. The key is thus supported across the output end of the housing structure, and is captured in place when the fitting 54 is attached to the housing structure 52. The boss key 80 has a central opening 80-1 which is adapted to receive a bushing 80B, which may be fabricated of a material such as nylon in an exemplary embodiment. A threaded fastener 80C such as a shoulder screw may be passed through the bushing 80B, the opening 80-1 in the key 80 and a washer 80A, and secured in a threaded bore formed in the end of the mixer rod 60. The mounting arrangement with the key 80 may allow rotation of the rod while permitting flow of mixed fluid from the output end of the housing.

The mixer rod 60 may be supported at the input end of the housing by a mounting arrangement which allows an end of the rod to protrude from the housing for engagement by the mixer drive system, and yet which provides a seal against leakage of the fluid being passed into the mixer at the inlet port 56A. An exemplary mounting arrangement includes an end cap 58, shown in FIG. 6, which may be inserted into the T fitting 56 at its open end, and secured in place, e.g. by gluing. In an exemplary embodiment, the end cap may be fabricated of a material such as PVC. The end cap 58 may have a center opening 58A, with an enlarged opening 58B at its interior end, as shown in FIG. 6. A bushing sleeve 90 is fitted into the enlarged opening 58B of the end cap; in an exemplary embodiment, the sleeve may be fabricated of bronze. The end of the mixer rod 60 is passed through the opening 58A and the bushing sleeve 90. A cup seal 92 is fitted onto the mixer rod and is captured between the shoulder transition between the portions 60A and 60B and the shoulder of the bushing 90.

To assemble the mixer 50 in an exemplary embodiment, the rod 60 with the mixer paddles 70 attached is inserted into the housing 52, after the fitting 54 has been secured in place with the boss key 80. The shoulder screw 80C may be secured into the threaded opening in the end of the rod 60. The end cap 58 may be assembled together with the seal 92, and brought onto the circular rod end so that it is passed through the opening formed in the end cap. The end cap may be secured in place, e.g. by adhesive. An end of the mixer rod 60 extends out the back end of the end cap, and may have a coupler attached to it for engagement with the mixer drive unit. The coupler may be a gear arrangement, or other type of coupler such as a socket arrangement to allow the mixer to be readily engaged with the drive unit.

The mixer paddles 70 may take different forms. In one exemplary embodiment depicted in FIG. 8, the paddles are planer elements fabricated from a rigid material such as sheet metal, e.g., carbon steel having a thickness of 0.047 inch in one example. Holes 70A are formed through the paddles to facilitate mixing of the fluid by allowing the fluid to pass through the paddle from one side to the other. In an exemplary embodiment, for a 2 inch diameter tube structure, a rod having 0.5 inch width, the paddles have a width of 1.85 inch and a length of 2.80 inch, with holes 70A having a diameter of 0.5 inch. The paddles in this embodiment have planar mixing surfaces 70B, which when attached to the mixer rod are positioned substantially parallel to the axis of the mixer rod.

Other exemplary embodiments of the mixer paddles are illustrated in FIGS. 9-13. In some applications, such as those involving highly viscous materials, it may be desirable to have alternate paddle shapes which provide not only a mixing function, but also provide an axial propulsion force to the materials being mixed. This propulsion force may reduce the load on the feed pumps, and assist in delivery of the mixed material through long hoses such as hose 102 to a specific point of application, The exemplary paddle structure 70-1 depicted in FIG. 9 is similar to paddle 70 of FIG. 8, except that edges are bent or formed to provide some axial propulsion force to the compounds being mixed in the dynamic mixer from the input port to the output port. The edges may be generally planar, formed by a simple sharp bend at a crease, such as edge 70-1A, or a rounded edge formed by a bend following a crease, such as edge 70-1B. The particular amount of axial propulsion force may be tuned by including a selected number of paddles 70-1 among a plurality of paddles 70.

Paddle structure 70-2 depicted in FIG. 10 employs a paddle hub section 70-2A connecting opposed paddle portions 70-2B, with the hub section having a cross-sectional opening configuration shaped to allow installation of the paddle structure onto a mixer rod. If the rod has a square cross-sectional configuration, the hub may also have a square opening configuration, forming a mating of the hub and rod which prevents rotation of the paddle structure on the rod.

The paddle structure 70-3 depicted in FIG. 11 may be attached to a mixing rod using rivets passed through holes 70-3A. In this case two of the paddle structures 70-3 may be positioning in facing relation, capturing the mixer rod between them, and with rivets passed through the holes 70-3A formed in each paddle structure.

Figure 12:
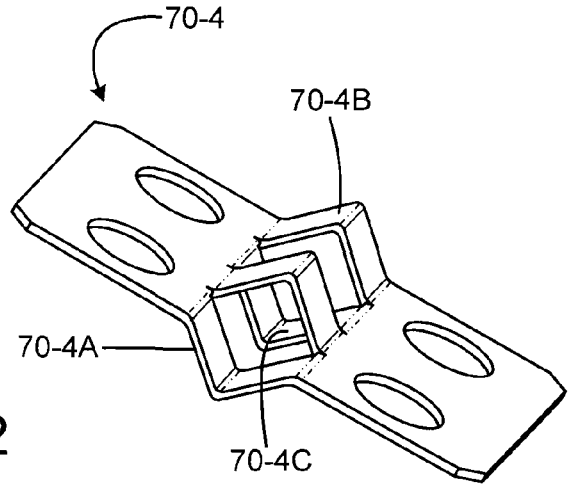
FIG. 12 is an isometric view of another exemplary embodiment of a mixer paddle structure.

FIG. 12 depicts another paddle structure 70-4, in which a hub section 70-4A is formed by stamping or forming opposed ribs 70-4B and 70-4C from a sheet material, e.g. sheet metal, to a configuration that will mate with the mixer rod configuration and interact with surfaces of the mixing portion of the rod to prevent rotation of the paddle relative to the rod. The sheet material may have slits formed therein, and the ribs formed by bending the ribs away from the plane of the sheet metal. For example, if the mixer rod has a square cross-sectional configuration, the hub section 70-4A is adapted to a square cross-sectional configuration, as depicted in FIG. 12. Several of the paddle structures 70-4 may be slipped onto a mixer rod, and avoid the use of threaded fasteners and the like.

Figure 13:
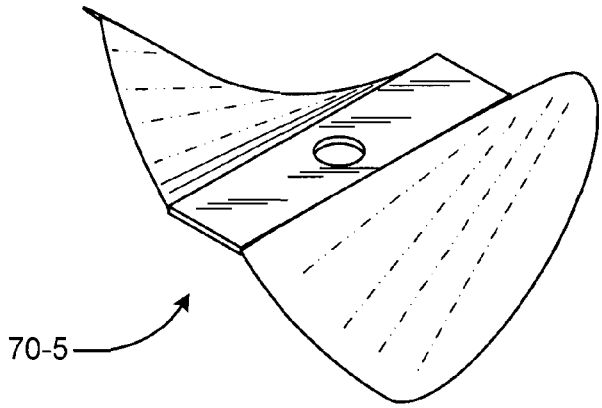
FIG. 13 is an isometric view of an exemplary embodiment of a paddle structure adapted to provide an axial propulsion force to a material being mixed.

FIG. 13 depicts an alternate paddle structure 70-5, in the form of a propeller structure. This structure may provide an axial propulsion force as described above. The paddle structure 70-5 may be positioned with other paddle structures, say paddles 70 or 70-4, for example, in series on the mixer rod, to provide a given amount of propulsive force for one structure 70-5, or more than one paddle structure 70-5 may be assembled in series or alternatively with other paddle structures if a greater amount of propulsion force is desired for a given application.

Referring again to FIG. 1, an exemplary embodiment of a dynamic mixer may be fitted with a sensor 100 adjacent its output. The sensor 100 may be, for example, a photosensor capable of distinguishing degrees of color or color intensity, or another sensor type capable of sensing another parameter. The sensor may generate an electronic sensor signal, which is connected to the control system 12 by wiring 101. The sensor and control system may be connected to provide a closed loop feedback control regarding color or other sensed parameter. The control system may, based on the sensor signal, adjust certain aspects of the mixing process, e.g., feed rate (progressing pump rate) or mixing rpm. In addition, or alternatively, the control system may generate an alarm signal or other operator notification based on the sensor signal.

In an exemplary embodiment, a dynamic mixer is simple and inexpensive to fabricate, from readily available materials. This may allow the user to dispose of the mixer instead of cleaning it after use. In this sense, and in an exemplary non-limiting embodiment, the mixer may be a disposable assembly. This may obviate time and expense in labor and solvents. The cleaning processes for some mixed compounds or liquids might involve the use of toxic materials, which might present a possible hazard to the cleaning operator. By providing, in one exemplary, non-limiting embodiment, a disposable dynamic mixer, e.g. of recyclable materials, the exemplary mixer may be recycled after use or disposed of in an ecologically sound manner, thereby reducing or eliminating operator exposure to toxic solvents while saving time and money to boot.

Although the foregoing has been a description and illustration of specific embodiments of the invention, various modifications and changes thereto can be made by persons skilled in the art without departing from the scope and spirit of the invention as defined by the following claims.

What is claimed is:

1. A dynamic mixer, comprising:

a hollow housing structure having a generally cylindrical mixing chamber and an inlet opening through which a material or materials to be mixed is passed into the mixing chamber, said hollow housing structure comprising a hollow tubular structure with first and second open ends, a hollow T fitting having a first opening attached to said first end of the hollow tubular structure, a second opening opposed to and in alignment with the first opening and a third opening transverse to said first and second openings, the third opening providing said inlet opening, and a coupler fitting attached to said second open end of the tubular structure;

a mixing rod having a mixing rod portion disposed in said housing structure;

a plurality of separate mixing paddles each having a mixing surface, the separate mixing paddles attached to the mixing portion of the mixing rod;

the mixing rod having a drive portion extending from said first open end of the tubular structure and said T fitting and adapted for attachment to a drive unit which imparts a rotational mixing force to the rod;

an end cap structure attached to said second opening of the T fitting for supporting the rod drive portion for rotation and sealing against material leakage;

a support structure positioned at the second open end of the tubular structure and secured in place by the coupler fitting, said support structure for supporting the drive rod while permitting material flow out the coupler fitting.

2. The mixer of claim 1, wherein said mixing surfaces of said plurality of mixing paddles have at least one opening formed there through to allow the material or materials undergoing mixing to pass through.

3. The mixer of claim 1, wherein said mixing portion of said mixing rod has a generally rectangular cross-sectional shape having first and second pairs of opposed rod surfaces.

4. The mixer of claim 3, wherein said mixing paddles are attached against respective surfaces of the first and second pairs of opposed rod surfaces.

5. The mixer of claim 4, further comprising attachment structures for attaching the mixing paddles to the mixing portion of the mixing rod, said attachment structure comprising at least one threaded bolt and nut fastener passed through a transverse opening in the rod.

6. The mixer of claim 1, wherein said hollow tubular structure is fabricated of a plastic material.

7. The mixer of claim 6, wherein said plastic material is a transparent material.

8. The mixer of claim 1, wherein said hollow tubular structure is a metal tube.

9. The mixer of claim 1, wherein said T fitting is adhesively attached at a first end of said tubular structure, and said coupler fitting is adhesively attached to said second end of said tubular structure.

10. The mixer of claim 1, wherein said plurality of mixing paddles each has a substantially flat mixing surface.

11. The mixer of claim 10, wherein said paddles are attached to the mixing rod portion of the mixing rod in an angularly staggered arrangement wherein adjacent paddles are angularly offset relative to each other and arranged such that the flat mixing surfaces of the paddles are substantially parallel to the mixing rod axis.

12. The mixer of claim 1, wherein said hollow tubular structure and said T fitting are each fabricated of a rigid plastic material, and said support structure includes a fitting fabricated of a rigid plastic material, and said T fitting and said support structure are adhesively attached to said tubular structure.

13. The mixer of claim 12, wherein the mixer is adapted to mix a plurality of materials, and wherein said plurality of materials are selected from the group consisting of multi-part epoxies, silicones, polyesters, urethanes, acrylics, and components to be mixed together to provide a composite color.

14. The mixer of claim 1, wherein said plurality of mixing paddles includes a mixing paddle adapted to provide an axial propulsion force to the material or materials undergoing mixing.

15. The mixer of claim 1, wherein said plurality of paddles includes at least one paddle comprising a hub portion having a cross-sectional configuration adapted to receive there through the mixer rod, and wherein said means for attaching comprises said hub portion.

16. The mixer of claim 15 wherein said cross-sectional configuration of said hub portion interacts with surfaces of said mixing portion of said rod to prevent rotation of said at least one paddle relative to said rod.

17. The mixer of claim 15, wherein said at least one paddle includes opposed ribs formed in a unitary structure with the mixing surfaces from a sheet material to a configuration that will mate with the mixer rod configuration and interact with surfaces of the mixing portion of the mixer rod to prevent rotation of the paddle relative to the rod.

18. The mixer of claim 1, further comprising a sensor for sensing a parameter of the material or materials at or adjacent an output of the mixer and providing an electronic sensor signal indicative of the sensed parameter.

19. The mixer of claim 18, wherein the parameter sensed is a color parameter of the material or materials undergoing mixing.

20. A dynamic mixer, comprising:

a hollow housing structure comprising a hollow tubular structure with first and second open ends, a hollow T fitting having a first opening attached to said first end of the hollow tubular structure, a second opening opposed to and in alignment with the first opening and a third opening transverse to said first and second openings, the third opening providing an inlet through which a fluid to be mixed is passed into the mixer, and a coupler fitting attached to said second open end of the tubular structure;

a mixing rod having a mixing rod axis and a mixing rod portion disposed in said housing structure;

a plurality of separate mixing paddles each having a mixing surface;

means for attaching the separate mixing paddles to the mixing portion of the mixing rod;

the mixing rod having a rod drive portion extending from said first open end of the tubular structure and said T fitting and adapted for attachment to a drive unit which imparts a rotational mixing force to the rod;

an end cap structure attached to said second opening of the T fitting for supporting the rod drive portion for rotation and sealing against material leakage;

a key structure positioned at the second open end of the tubular structure and secured in place by the coupler fitting, said key structure for supporting the drive rod while permitting material flow out the coupler fitting.

21. The mixer of claim 20, wherein said mixing surfaces of said plurality of mixing paddles have at least one opening formed there through to allow the material or materials undergoing mixing to pass through.

22. The mixer of claim 20, wherein said mixing portion of said mixing rod has a generally rectangular cross-sectional shape having first and second pairs of opposed rod surfaces.

23. The mixer of claim 22, wherein said mixing paddles are attached against respective surfaces of the first and second pairs of opposed rod surfaces.

24. The mixer of claim 20, wherein said hollow tubular structure is fabricated of a plastic material.

25. The mixer of claim 20, wherein said hollow tubular material includes a transparent portion allowing viewing of the material or materials undergoing mixing.

26. A dynamic mixer, comprising:

a hollow housing structure having a generally cylindrical mixing chamber, and an inlet opening through which a material or materials to be mixed is passed into the mixing chamber, said hollow housing structure comprising a hollow tubular structure with first and second open ends, a hollow T fitting having a first opening attached to said first end of the hollow tubular structure, a second opening opposed to and in alignment with the first opening and a third opening transverse to said first and second openings, the third opening providing said inlet opening, and a coupler fitting attached to said second open end of the tubular structure;

a mixing rod supported for rotation about a mixing rod axis in said housing structure, said mixing rod having a mixing portion;

a plurality of mixing paddles each having substantially flat mixing surfaces, the plurality of paddles attached to the mixing rod portion of the mixing rod in an angularly staggered arrangement wherein adjacent paddles are angularly offset relative to each other and arranged such that the flat mixing surfaces of the paddles are substantially parallel to the mixing rod axis;

an end cap assembly disposed at or adjacent said second opening of the T fitting for supporting the rod at a rod bushing portion and for sealing against material leakage;

a support structure disposed at or adjacent said second open end of the tubular structure for supporting the rod for rotation while permitting material flow out said second open end;

the mixing rod having a drive end extending from said first open end of the T fitting and adapted for attachment to a drive unit which imparts a rotational mixing force to the rod.

27. The mixer of claim 26, wherein said mixing surfaces of said plurality of mixing paddles have at least one opening formed there through to allow the material or materials undergoing mixing to pass through.

28. The mixer of claim 26, wherein said mixing rod has a generally rectangular cross-sectional shape having first and second pairs of opposed rod surfaces.

29. The mixer of claim 28, wherein said mixing paddles are attached against respective surfaces of the first and second pairs of opposed rod surfaces.

30. The mixer of claim 26, wherein said hollow tubular structure is fabricated of a plastic material.

31. The mixer of claim 26, wherein said housing structure includes a transparent portion.

32. A dynamic mixer, comprising:

a hollow housing structure having a generally cylindrical mixing chamber, opposed first and second openings and an inlet opening through which a material or materials to be mixed is passed into the mixing chamber, said hollow housing structure comprising a hollow tubular structure with first and second open ends, a hollow T fitting having a first opening attached to said first end of the hollow tubular structure, a second opening opposed to and in alignment with the first opening and a third opening transverse to said first and second openings, the third opening providing said inlet opening, and a coupler fitting attached to said second open end of the tubular structure;

a mixing rod and paddle structure supported for rotation about a mixing rod axis in said housing structure, said mixing rod and paddle structure having a rod mixing portion and a plurality of mixing paddle portions protruding from the rod mixing portion, each mixing paddle portion having at least one mixing surface;

an end cap assembly disposed at or adjacent said second opening of the T fitting for supporting the rod and paddle structure at a rod bushing portion and for sealing against material leakage;

a support structure disposed at or adjacent said second open end of the coupler fitting for supporting the rod and paddle structure for rotation while permitting fluid flow out said second open end;

the mixing rod and paddle structure having a drive end extending from said first open end of the tubular structure and the T fitting, and adapted for attachment to a drive unit which imparts a rotational mixing force to the rod and paddle structure.

33. The mixer of claim 32, wherein said hollow tubular structure is fabricated of a plastic material.

34. The mixer of claim 32, wherein said hollow tubular structure includes a transparent portion.

* * * * *